US008394349B2

(12) United States Patent
Eglmeier et al.

(10) Patent No.: US 8,394,349 B2
(45) Date of Patent: Mar. 12, 2013

(54) HOUSEHOLD APPLIANCE HAVING AN OZONE GENERATOR AND AN OZONE ELIMINATING DEVICE, AND RELATED METHOD

(75) Inventors: Hans Eglmeier, Berlin (DE); Hartmut Schaub, Brieselang (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 13/375,243

(22) PCT Filed: Jun. 1, 2010

(86) PCT No.: PCT/EP2010/057601

§ 371 (c)(1),
(2), (4) Date: Nov. 30, 2011

(87) PCT Pub. No.: WO2010/142566

PCT Pub. Date: Dec. 16, 2010

(65) Prior Publication Data

US 2012/0070352 A1 Mar. 22, 2012

(30) Foreign Application Priority Data

Jun. 8, 2009 (DE) ..... 10 2009 026 827

(51) Int. Cl.

| | |
|---|---|
| ***A47L 15/42*** | (2006.01) |
| ***B01D 53/66*** | (2006.01) |
| ***B01D 53/74*** | (2006.01) |
| ***D06F 29/00*** | (2006.01) |
| ***F26B 19/00*** | (2006.01) |

(52) U.S. Cl. ..... 423/219; 34/60; 34/78; 34/524; 134/56 D; 134/58 D; 134/94.1; 68/13 R

(58) Field of Classification Search ..... 423/219; 34/60, 78, 524; 134/56 D, 58 D, 94.1; 68/13 R
See application file for complete search history.

(56) References Cited

U.S. PATENT DOCUMENTS

| | | | | |
|---|---|---|---|---|
| 4,941,270 | A * | 7/1990 | Hoffman | 34/60 |
| 2006/0096038 | A1 | 5/2006 | Daniels et al. | |
| 2008/0011329 | A1* | 1/2008 | Classen et al. | 134/25.2 |
| 2008/0092601 | A1 | 4/2008 | Konides et al. | |
| 2008/0302139 | A1 | 12/2008 | Zorn | |
| 2010/0313610 | A1* | 12/2010 | Smith et al. | 68/13 R |

FOREIGN PATENT DOCUMENTS

| | | | |
|---|---|---|---|
| DE | 2433909 | A1 | 2/1976 |
| DE | 3232057 | A1 | 3/1984 |
| EP | 0699470 | A1 | 3/1996 |
| WO | 2007143785 | A1 | 12/2007 |
| WO | 2008119631 | A1 | 10/2008 |

OTHER PUBLICATIONS

International Search Report PCT/EP2010/057601, Aug. 2011.
National Search Report DE 10 2009 026 827.8, Feb. 2010.

* cited by examiner

*Primary Examiner* — Timothy Vanoy
(74) *Attorney, Agent, or Firm* — James E. Howard; Andre Pallapies

(57) ABSTRACT

A household appliance includes a container for receiving objects to be treated, an ozone generator having an intake air conduit, and an ozone eliminating device arranged in an exhaust air conduit. The exhaust air conduit is connected to the container and includes a fan for removing exhaust air from the container. The exhaust air conduit is connected to the intake air conduit of the ozone generator.

16 Claims, 2 Drawing Sheets

HOUSEHOLD APPLIANCE HAVING AN OZONE GENERATOR AND AN OZONE ELIMINATING DEVICE, AND RELATED METHOD

BACKGROUND OF THE INVENTION

The invention relates to a household appliance having a container for receiving objects to be treated, and an ozone generator, and an ozone eliminating device, wherein the ozone eliminating device is arranged in an exhaust air conduit, said exhaust air conduit being connected to the container. The invention also relates to a method for eliminating ozone in such a household appliance.

A household appliance and a method of the type cited in the introduction are set out in the publication DE 32 32 057 A1.

The use of ozone in a household appliance, in particular in a washing machine or another appliance for laundry care, has gained desirability recently. Ozone is not only a strong disinfection agent, it also interacts with a cleaning or care agent used in a household appliance to produce complex and rapid reactions, which can produce an improved care or cleaning effect.

Ozone can be generated in different ways in a household appliance, for instance by means of a UV lamp generator by irradiating oxygen with UV radiation below 200 nm, or by means of a corona discharge, in which oxygen is exposed to an electrical discharge in the form of a corona. The corona is generated by applying a high voltage of generally at least 5000 V to a suitable arrangement of electrodes.

Ozone is expended very quickly in wash liquor, particularly at a high temperature. Since ozone is however a particularly unpleasant smelling irritant, and may be corrosive, the escape of small quantities from a household appliance must be prevented irrespective of the presence of appropriate means and conditions in the household appliance, which may be conducive to eliminating ozone which is no longer wanted.

WO 2007/143785 A1 describes a system and a device for introducing ozone into a washing machine. The system contains a first pipeline for introducing ozone originating from an ozone supply into a wash fluid inlet and a second pipeline for discharging ozone into a region above a wash chamber. A venturi nozzle is used to introduce ozone and to mix it with wash fluid. The venturi nozzle here is operatively coupled to wash fluid inlet means so as to draw the ozone into the wash fluid, as the wash fluid is introduced into the washing tub.

WO 2008/119631 A1 describes a washing machine, in which microorganisms present in a detergent distributor, i.e. a soap drawer, are eliminated by the direct introduction of ozone from an ozone generator into the soap drawer. In one embodiment, water is introduced into the soap drawer at the same time as the ozone, so that the ozone/water mixture is routed through the soap drawer. The possibility of ozone escaping from the washing machine is intended to be minimized by these means.

US 2008/0302139 A1 discloses a tunnel washer, which includes a plurality of zones for continuously washing laundry, two points for injecting ozone, a water circuit, which connects a water input and a water output, with the water circuit including a water storage container and a venturi injector for dissolving ozone in water, as well as an ozone generator. A negative pressure or a vacuum can be applied to the tunnel washer by way of an ozone eliminating device, in order to prevent ozone leakages. A fan can be used to generate the negative pressure. Excess or escaping ozone can be catalytically converted back to normal oxygen in the ozone eliminating device.

US 2006/0096038 A1 describes a system for monitoring ozone and for controlling the supply of ozone to a washing machine. An ozone sensor indicates that a fixed ozone limit value is exceeded, whereupon an ozone generator is switched off, until the ozone concentration is once again below this limit value. There is no provision for elimination of ozone.

DE 32 32 057 A1 describes a cleaning machine for laundry, dishes or suchlike with a storage container for a detergent and an ozone generator, to the output of which an ozone supply line, which opens therein, is connected for the purpose of ozonizing the detergent. In one embodiment, a vent line and a facility consisting of a heating spiral for eliminating ozone are assigned to the storage container. FIG. 1 shows a washing machine, in which an ozone generator comprises a compressor, so that the ozone can flow into the storage container with the necessary high pressure. An overflow is used as a vent line, through which the air resulting at low pressure above the detergent level can escape. The overflow here can be provided with a heating device, which is heated to such a high temperature that any remaining ozone in the air is destroyed before the air reaches the surroundings. An active carbon filter can also be present instead.

DE 24 33 909 A1 describes an appliance for caring for items of clothing having a cabinet-type housing which can be closed with a door with a receiving space for items of clothing, to which the intake and outlet side of a circulating air ventilator are connected with an air heater in between, with the receiving space connecting to the outer space by way of a fresh air filter and the intake side of an exhaust air ventilator being connected to the receiving space, while its outlet ends in an opening of an exterior wall of the housing. At least one ozonizer is provided for the air of the receiving space. In one embodiment of this appliance, the outlet of the exhaust air ventilator is connected to the outer space, with an exhaust air filter being arranged in the exhaust air path, the filter material of which consists of active carbon.

EP 0 699 470 A1 describes a method for eliminating ozone from gases or fluids, in which the gas to be treated or the fluid to be treated is treated with a physical method in order to remove the ozone and is then brought into contact with a polymer which binds the ozone. In the physical method, a catalyzer, thermal energy and/or radiation energy are used in particular. The polymer which binds the ozone is in particular polyarylene thioether, polyarylene ether or a macroporous copolymer.

US 2008/092601 A1 describes an open washing system using ozone as well as a method for washing safely using high concentrations of ozone. In a washing machine comprising an ozone generator, an exhaust air conduit is for instance connected to the container receiving laundry, wherein an ozone eliminating device having a catalyzer for catalytically converting ozone to oxygen and a fan for taking in air containing ozone are arranged in the exhaust air conduit.

Against this background the object of the invention is to provide a household appliance with an ozone generator, wherein an escape of ozone can be effectively prevented. The possible escape of excess ozone from the household appliance is preferably to be eliminated here. The subject matter of the invention is also a method for operating this household appliance.

BRIEF SUMMARY OF THE INVENTION

The object underlying the invention is achieved by a household appliance and a method according to the respective independent claim. Preferred embodiments of the invention are detailed in the respective dependent claims. Preferred embodiments of the inventive method correspond to preferred embodiments of the inventive household appliance, even if reference is not specifically made to this here.

The invention therefore sets out a household appliance with a container for receiving objects to be treated and an ozone generator and an ozone eliminating device, with the ozone eliminating device being arranged in an exhaust air conduit, said exhaust air conduit being connected to the container. The exhaust air conduit here also comprises a fan for removing exhaust air from the container.

Provision is correspondingly made in accordance with the invention for the ozone to be eliminated by a system, which removes exhaust air filled with ozone using suction from the container and accordingly from lines and suchlike which communicate therewith.

The objects to be treated may for instance be objects to be cleaned. The household appliance enables the household appliance and in particular the container for receiving objects to be treated to be given a slightly negative pressure, so that fresh air is drawn out from all the openings that may be present in the container.

The ozone eliminating device is preferably arranged between the container and the fan. The objects to be treated are not restricted in accordance with the invention. The objects to be cleaned may be in particular dishes or laundry. The term cleaning is also understood to mean freshening up in accordance with the invention.

In the ozone eliminating device, ozone is eliminated in particular in that it is absorbed or broken down on a suitable material. Breaking down may take place for instance in that the ozone reacts chemically with a suitable material or is catalytically broken down, forming oxygen for instance.

In a preferred embodiment of the inventive household appliance, the ozone eliminating device includes a filter unit, with the filter unit preferably including a material containing carbon or another easily oxidizable material. It is preferable again for the material containing carbon to be at least one substance, which is selected from the group consisting of active carbon, polyarylene thioethers, polyarylene ethers and macroporous copolymers. Suitable polyarylene thioethers, polyarylene ethers and macroporous copolymers are for instance described in EP 0 699 470 A1.

Active carbon is used particularly preferably as the material containing carbon. Active carbon is generally broken down by ozone forming carbon dioxide, so that the quantity of active carbon in a filter unit gradually reduces. In a preferred embodiment, the household appliance therefore comprises an inspection glass which is arranged on the ozone eliminating device. A user of the household appliance can therefore detect, even without the presence of an ozone sensor, whether the filter unit is still functioning correctly, in that sufficient active carbon is still present for instance.

An ozone generator which is preferably used in an inventive household appliance generates approximately 20 mg/h to 30 mg/h of ozone. The use of a filter unit, which is charged with approximately 10 g active carbon, is generally sufficient here for the whole operating period of the household appliance.

The exhaust air conduit may lead into an installation space of the household appliance, since the exhaust air only contains small quantities of carbon dioxide and no other problematic components.

One advantage of the inventive household appliance is that an ozone sensor is not needed. The inventive household appliance can however advantageously comprise an ozone sensor for measuring an ozone content.

Alternatively or in addition to a filter unit the ozone eliminating device in the inventive household appliance comprises a catalyzer for breaking down ozone, for instance a catalyzer for converting ozone to oxygen.

The household appliance enables the automatic elimination of ozone within the household appliance. Particular information relating to this is not required for the user of the household appliance.

However, the household appliance can also contain a display device relating to the ozone elimination. The display device may be an optical and/or acoustic display device. The household appliance preferably then comprises a display device for non-functioning ozone elimination. Non-functioning ozone elimination exists for instance if an ozone sensor present determines an ozone concentration which lies above a predetermined limit value, e.g. 1 ppm. If there is no ozone sensor present in the household appliance, non-functioning ozone elimination can exist if the fan or the ozone eliminating device does not function correctly. The latter may be the case for instance if a material which contains carbon in a filter unit is used up or a catalyzer for the catalytic breakdown of the ozone is contaminated.

In the inventive household appliance, a control facility is generally present, which, in addition to controlling a cleaning program, can also take countermeasures in the event of non-functioning ozone elimination. With non-functioning ozone elimination, the control facility can switch off the ozone generator and/or bring about a corresponding acoustic and/or optical display on the display device.

With the invention the exhaust air conduit is connected to an intake air conduit of the ozone generator in the household appliance. A fan which may be needed for operation of the ozone generator is therefore superfluous in an intake air conduit of the ozone generator. In a particularly preferred embodiment, the exhaust air conduit is connected to the intake air conduit by way of a pitot tube. As a result, an air flow which is required for the ozone generator is generated particularly efficiently.

The fan present in the inventive household appliance is generally used such that a flow resulting in the exhaust air conduit through the ozone eliminating device is sufficiently large to prevent an escape of air which contains ozone through other openings in the household appliance. In particular the fan, generally the household appliance, will above all give the container for receiving objects to be cleaned a slightly negative pressure so that fresh air is taken in from all the openings that may be present in the household appliance. The flow speeds which result are preferably greater here than the diffusion speed of the ozone molecules.

The inventive household appliance is particularly preferably a washing machine, a washer dryer, a dryer or a dishwasher.

A washing machine generally comprises a tub as well as a drum which is rotatably mounted in the tub for receiving items of laundry to be cleaned. Furthermore, a washing machine generally also comprises a drain outlet system arranged in the bottom of the tub with a drain pump and generally also laundry agitators and/or scooping devices.

In a preferred embodiment of the invention, in which the household appliance is a washing machine, a pressure sensor and/or a temperature sensor are arranged in the tub. The pressure and temperature sensor, if present, are preferably arranged in a lower region of the tub, so that the pressure and/or temperature of an aqueous fluid present in the tub can be measured.

In the household appliance, the ozone can be introduced as a gas or in an aqueous solution.

The subject matter of the invention is also a method for eliminating ozone in a household appliance. A method for eliminating ozone in a household appliance having a container for receiving objects to be treated and an ozone generator and an ozone eliminating device, wherein the ozone eliminating device is arranged in an exhaust air conduit, said exhaust air conduit being connected to the container. Here air is drawn out of the container into the exhaust air conduit using a fan arranged in the exhaust air conduit, and is conveyed through the ozone eliminating device with the air from the exhaust air conduit preferably being routed at least partially into an intake air conduit for the ozone generator.

The objects to be treated may be for instance objects to be cleaned.

With the inventive method, the household appliance in particular, above all the container holding the objects to be treated, is given a slightly negative pressure so that fresh air is preferably drawn out from all the openings that may be present in the household appliance.

The ozone to be eliminated in the household appliance can come from any source. Therefore ozone can be introduced in the household appliance in the form of a gas or an aqueous solution.

Advantageously the fan is still operated for a predetermined period of time, even if the ozone generator is already shut down.

In a preferred embodiment of this method, a display device shows when the elimination of ozone does not function correctly as described above.

The invention is advantageous in that an escape of ozone from a household appliance with an ozone generator can be prevented in a simple and very efficient fashion. This is also possible in particular, even if the household appliance is not hermetically sealed against air in an installation space. Excess ozone is not only preventing from escaping but is largely broken down by an ozone eliminating device.

DETAILED DESCRIPTION OF EXEMPLARY EMBODIMENTS OF THE PRESENT INVENTION

Exemplary embodiments of the invention are illustrated below with the aid of FIGS. 1 and 2, with a washing machine being cited as an example of an inventive household appliance.

Figure 1:
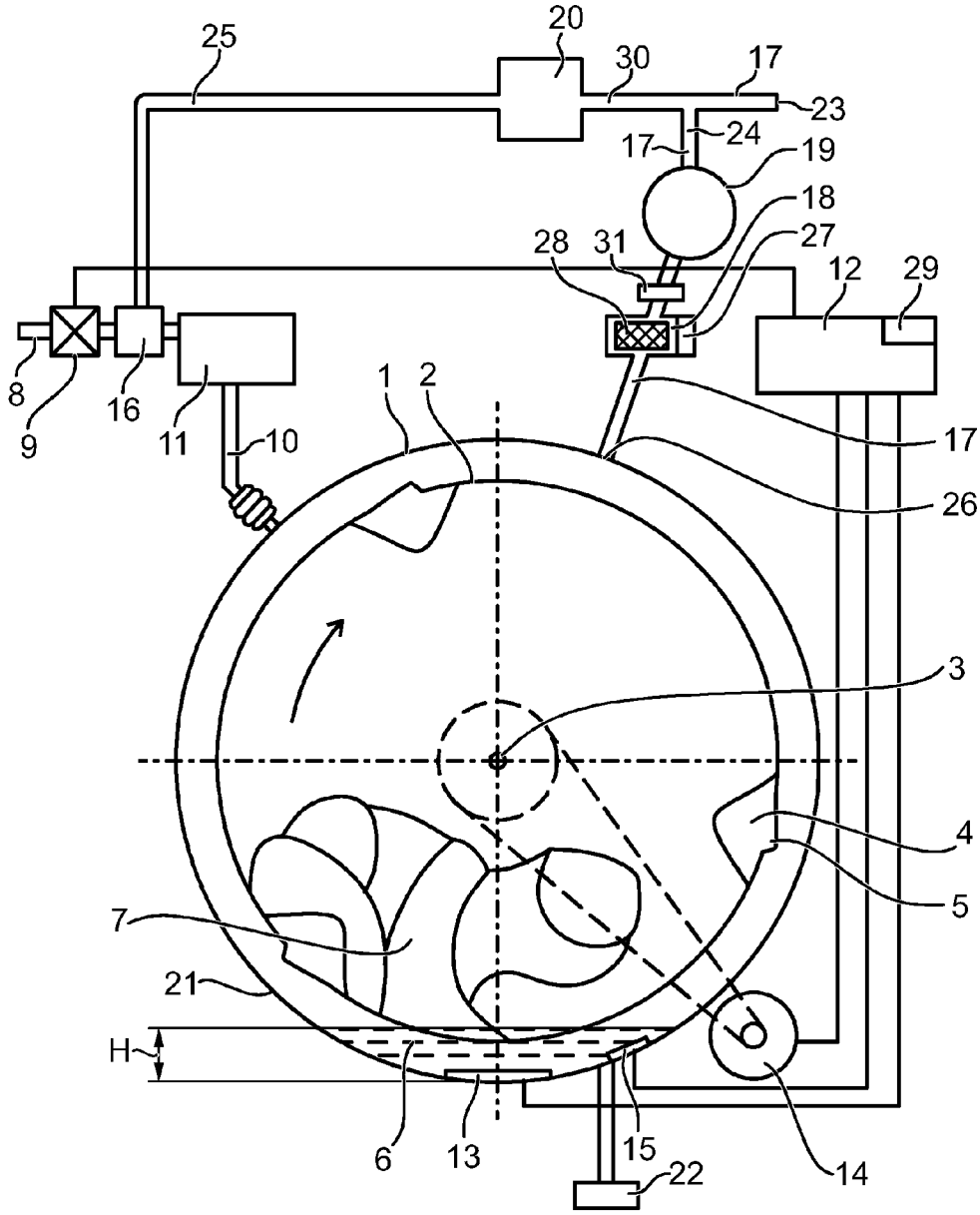
FIG. 1 illustrates of an exemplary embodiment of a household appliance in accordance with the present invention.

FIG. 1 shows a schematic representation of the parts of an embodiment of a household appliance which are relevant to the present explanation, in this instance a washing machine, in which a method which is subsequently to be explained can be implemented. Other embodiments are conceivable. The washing machine shown in FIG. 1 comprises a tub 1, in which a drum 2 is rotatably mounted and can be operated by a drive motor 14. The arrow shows the rotational direction of the drum and 3 indicates the axis of rotation of the drum 2.

In conjunction with particularly shaped laundry agitators 4 and scooping devices 5 for the wash liquor 6 on the inner surface of the drum casing, this arrangement also achieves an intensification of the flow of wash liquor through the laundry items 7 and a reduction in the free liquor, in other words the quantity of wash liquor in the tub 1, which can no longer be absorbed by the laundry which is saturated with wash liquor.

The washing machine in the embodiment of a household appliance shown here also comprises a wash liquor intake system, which includes a water connection fitting for the mains water network 8, an electrically controllable valve 9 and a feed line 10 to the tub 1, which is guided by way of a detergent dispenser facility ("soap drawer") 11, from which the intake water can transport detergent portions into the tub 1. A venturi nozzle 16, which is connected to an ozone generator 20 by way of an ozone supply line 25, is present in the feed line 10. The water from the mains water network 8 flowing in the feed line 10 draws in air containing ozone that is present in the ozone supply line 25 by way of the venturi nozzle 16. As a result ozone reaches the tub 1 together with water or wash liquor. However ozone can also be introduced as gas into the containers for receiving objects to be treated. An input 26 into the exhaust air conduit 17 is present in the tub wall 21, in which exhaust air conduit 17 an ozone eliminating device 18, an ozone sensor 31 and a fan 19 are present. The exhaust air conduit 17 leads to an exhaust air output 23, which protrudes here into an installation space of the washing machine.

A filter unit 28, which, in the currently described exemplary embodiment, contains active carbon as a material which contains carbon, is present in the ozone eliminating device 18. An inspection glass 27 is arranged on the ozone eliminating device 18, by way of which a user of the washing machine can identify whether material which contains carbon is still present in the filter unit 28.

A display device 29 is present on the washing machine of the specific embodiment shown here for the acoustic and/or optical display of an elimination of ozone which is not functioning correctly.

With the specific embodiment shown here, an intake air conduit 30 for the ozone generator 20 branches between the fan 19 and the exhaust air output 23 at a pitot tub 24. As a result the fan 29 can be used simultaneously to operate the ozone generator 20 and also to operate the ozone eliminating device 18. The fan 19 has an output which is sufficient to generate a negative pressure.

A heater 13 is also present in the tub 1. Embodiments without heaters are however conceivable. The valve 9 and also the heater 13 can be controlled by a control facility 12 as a function of a schedule, which can be tied to a time program and/or to the achievement of certain measured values of parameters such as wash liquor level, wash liquor temperature, drum speed, etc. within the washing machine.

In FIG. 1, 15 indicates a pressure sensor for measuring the hydrostatic pressure p in the tub 1. The hydrostatic pressure p results from the fill level H of the free liquor forming in the tub 1. The signals of the drive motor 14, pressure sensor 15, ozone generator 20, fan 19, ozone sensor 31 etc. are fed to the control facility 12, although this is not shown for the sake of clarity.

Figure 2:
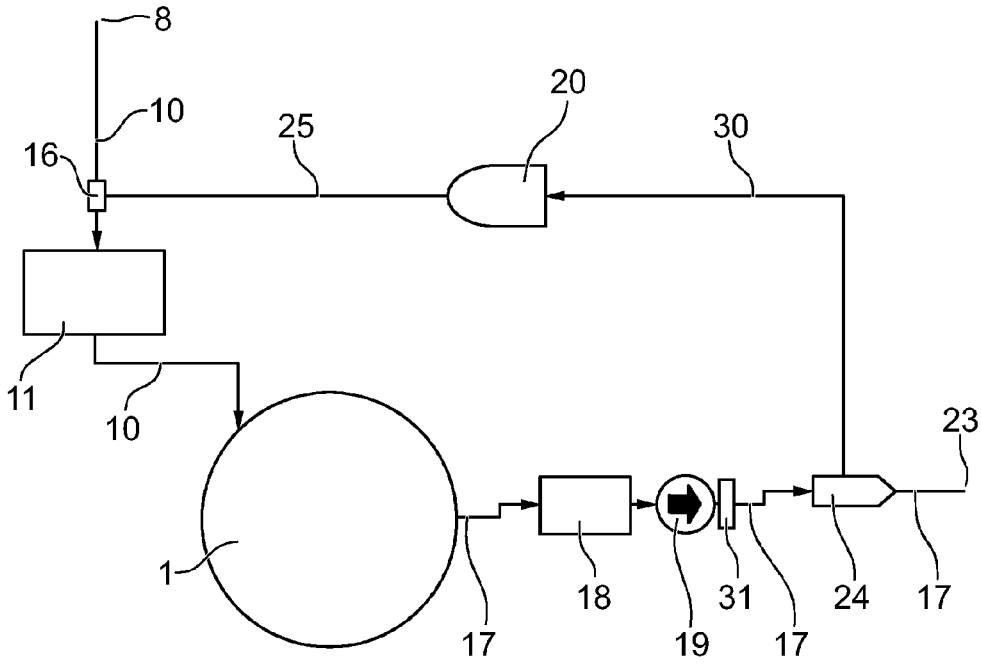
FIG. 2 is a schematic illustration of an exemplary embodiment of a household appliance in accordance with the present invention.

FIG. 2 shows a more schematic view than FIG. 1 of the currently relevant parts of a washing machine as an embodiment of a household appliance. In the embodiment shown here, it is particularly apparent how both an ozone generator 20 and also an ozone eliminating device 18 can be operated using a single fan 19. The fan 19 has sufficient power to generate a negative pressure.

In FIG. 2, air is to this end fed to the ozone generator 20 by way of an intake air conduit 30, said air originating at least partially from an exhaust air conduit 17, in which the ozone eliminating device 18 is arranged together with a fan 19 and an ozone sensor 31. A pitot tube 24 here contributes to a suitable pressure in the intake air conduit 30.

The ozone generated in the ozone generator 20 is drawn by way of an ozone supply line 25, which is connected to a venturi nozzle 16, on account of the water from the mains water network 8 flowing in a feed line 10 through the venturi nozzle 16. Together with the water, the ozone reaches the soap drawer 11 and the tub 1. Other embodiments, in which gaseous ozone is used, are conceivable. An exhaust air conduit 17, in which air containing ozone is drawn from the tub into the ozone eliminating device 18 by means of a fan 19, passes from the tub 1.

Provided it is not routed into the intake air conduit 30, the exhaust air from the exhaust air conduit 17 is fed to the installation space of the washing machine by way of an exhaust air output 23.

LIST OF REFERENCE CHARACTERS

1 Container for receiving objects to be treated, e.g. tub
2 Drum
3 Axis of rotation
4 Laundry agitator
5 Scooping device
6 Wash liquor
7 Items of laundry
8 Mains water network
9 Electrically controllable valve
10 Feed line to the tub
11 Detergent dispensing facility
12 Control facility
13 Heater
14 Drive motor
15 Pressure sensor
16 Venturi nozzle
17 Exhaust air conduit
18 Ozone eliminating device
19 Fan
20 Ozone generator
21 Tub wall
22 Pump
23 Exhaust air output
24 Pitot tube
25 Ozone supply line
26 Input into the exhaust air conduit
27 Inspection glass
28 Filter unit
29 Display device
30 Intake air conduit for the ozone generator
31 Ozone sensor

The invention claimed is:

1. A household appliance, comprising:

a container for receiving objects to be treated;

an ozone generator having an intake air conduit; and an ozone eliminating device arranged in an exhaust air conduit, said exhaust air conduit being connected to the container and comprising a fan for removing exhaust air from the container, said exhaust air conduit being connected to the intake air conduit of the ozone generator.

2. The household appliance of claim 1, wherein the ozone eliminating device comprises a catalyzer for breaking down ozone.

3. The household appliance of claim 1, wherein the ozone eliminating device includes a filter unit.

4. The household appliance of claim 3, wherein the filter unit includes a material which contains carbon.

5. The household appliance of claim 4, wherein the material is at least one substance selected from the group consisting of active carbon, polyarylene thioethers, polyarylene ethers and macroporous copolymers.

6. The household appliance of claim 4, wherein the material is active carbon.

7. The household appliance of claim 3, wherein the filter unit includes oxidizable material.

8. The household appliance of claim 1, further comprising an inspection glass arranged on the ozone eliminating device.

9. The household appliance of claim 1, further comprising an ozone sensor for measuring an ozone content.

10. The household appliance of claim 1, further comprising a display device for indication when ozone elimination malfunctions.

11. The household appliance of claim 1, further comprising a pitot tube for connecting the exhaust air conduit to the intake air conduit.

12. The household appliance of claim 1, constructed in the form of a washing machine, a washer dryer, a dryer or a dishwasher.

13. The household appliance of claim 1, wherein the ozone eliminating device is arranged between the container and the fan.

14. A method for eliminating ozone in a household appliance, comprising:

drawing air from a container for receiving objects to be treated by a fan arranged in an exhaust air conduit connected to the container and conveying the air through an ozone eliminating device arranged in the exhaust air conduit; and routing air from the exhaust air conduit at least partially into an intake air conduit for an ozone generator.

15. The method of claim 14, wherein the container is maintained under slight negative pressure.

16. The method of claim 14, further comprising indicating by a display device a state when ozone elimination malfunctions.

* * * * *